US006196176B1

(12) United States Patent
Groh et al.

(10) Patent No.: US 6,196,176 B1
(45) Date of Patent: Mar. 6, 2001

(54) SWITCHABLE CAM FOLLOWER

(75) Inventors: David M. Groh, Troy; Troy Kraemer, South Lyon, both of MI (US); Oliver Schnell, Weisendorf (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/460,749

(22) Filed: Dec. 14, 1999

Related U.S. Application Data

(60) Provisional application No. 60/112,415, filed on Dec. 15, 1998.

(51) Int. Cl.[7] ..... F01L 1/14; F01L 13/00

(52) U.S. Cl. ..... 123/90.16; 123/90.5; 123/90.55; 123/198 F

(58) Field of Search ..... 123/90.15, 90.16, 123/90.17, 90.48, 90.49, 90.5, 90.55, 90.6, 198 F

(56) References Cited

U.S. PATENT DOCUMENTS

| | | | | |
|---|---|---|---|---|
| 5,203,289 | * | 4/1993 | Hara et al. | 123/90.16 |
| 5,558,052 | * | 9/1996 | Schwarzenthal et al. | 123/90.16 |
| 5,934,232 | * | 8/1999 | Greene et al. | 123/90.16 |
| 5,950,583 | * | 9/1999 | Kraxner et al. | 123/90.16 |

* cited by examiner

*Primary Examiner*—Weilun Lo
(74) *Attorney, Agent, or Firm*—Bierman, Muserlian and Lucas

(57) ABSTRACT

A switchable cam follower (1) for a valve train of an internal combustion engine, which valve train is actuated by tappet push rods, the cam follower (1) comprises an outer section (4) and an inner section (5) which are adapted to be switched off through a coupling device (22) by the lift of a loading cam, a locking device (27) associated with the coupling device (2) and cooperates with a single track on the cam, the locking device (27) prevents displacement of the coupling device (2) outside of a defined part of the base circle phase of the cam.

7 Claims, 2 Drawing Sheets

SWITCHABLE CAM FOLLOWER

PRIOR APPLICATION

This application is based upon provisional patent application Ser. No. 60/112,415 filed Dec. 15, 1998.

DESCRIPTION

FIELD OF THE INVENTION

The invention concerns a switchable cam follower for a valve train of an internal combustion engine, which valve train can be actuated indirectly by tappet push rods, said cam follower having the following features:

- the cam follower can be installed in driving relationship between a camshaft and an end of the tappet push rod, said cam follower comprising an outer and an inner section as well as coupling means,
- the outer section can be inserted with its outer peripheral surface into a reception of the internal combustion engine, the inner section being mounted in a recess of the outer section while being movable relative to the outer section,
- one of said sections has a support for the end of the tappet push rod and the other of said sections has an axially opposite contacting surface for a cam of the camshaft,
- said sections can be coupled to each other by the coupling means so that on coupling, a high lift of a valve train gas exchange valve loadable by the tappet push rod can be effected and, on uncoupling of the sections by the coupling means, a low lift or a zero lift of the gas exchange valve is obtainable.

BACKGROUND OF THE INVENTION

A cam follower of the pre-cited type is known from U.S. Pat. No. 5,361,733. A drawback of this cam follower is that no means are provided for excluding switching errors of its coupling means. Since, as a rule, such a cam follower is switched in a base circle phase of the cam in which its two sections bear uniformly against the base circle of the cam and the receptions for the coupling means are aligned to each other during this base circle phase, it is possible, for example at high speeds of rotation or due to other influences such as pressure medium fluctuations and the like, that, when leaving the base circle of the cam, i. e. at the beginning of the run-on flank, the coupling means have not yet reached their coupling or uncoupling position. If in such a transition state, the coupling means concerned overlaps an annular surface between the sections only slightly, the cam lift can be interrupted resulting in a considerable loading of the components and noise generation. With a too gradual servo medium pressure build-up in front of the coupling means for the desired coupling, especially at high rotational speeds, it is likewise possible that the coupling means do not reach their full coupling position.

OBJECT OF THE INVENTION

It is therefore an object of the invention to create a switchable cam follower of the pre-cited type in which the aforesaid drawbacks are eliminated and, particularly, switching errors of the coupling means are avoided by relatively simple constructional measures.

SUMMARY OF THE INVENTION

The invention achieves these objects by the fact that locking means are associated to the coupling means, and the locking means are configured so as to permit a displacement of the coupling means during a contact of a, as seen in rotating direction, first portion of a base circle of the cam and to block a displacement of the coupling means during a contact of a last portion or an end of a base circle of the cam and during contact of an adjoining first portion of a run-on flank of the cam.

Due to the locking means of the invention, the at least one coupling means which is made preferably as a piston is fixed in one of its end positions (uncoupled state—coupled state) till a sufficiently large or small servo medium pressure for its displacement or return displacement is formed. The initially described switching errors caused by insufficient servo medium pressure in front of the at least one coupling means are thus effectively eliminated. It is further pointed out that even undesired servo medium pressure fluctuations during the rotation of the cam can no longer cause an undesired displacement of the coupling means.

An important aspect is that the coupling means are fixed directly at the end of the base circle in one of their end positions. Advantageously, the fixed state continues to exist during a contact of a first portion of a run-on flank of the cam.

It is possible to use differently configured locking means and also such that function independently of a track on the cam. Advantageously, however, as proposed by the invention, the locking means is made as a slide which, at one end scans a signal track on the loading cam and cooperates at the other end with the coupling means. Depending on the configuration of the locking means, the signal track can extend groove-shaped or as an elevation on the outer peripheral surface of the loading cam. Advantageously, the blocking of the coupling means by the locking means is realized already shortly before the end of the base circle of the cam. This guarantees with a high degree of certainty that, with starting cam lift, the coupling means has taken a defined end position.

If the end position of the coupling means has not been fully reached, the proposed wedge shape of the catch recesses causes a forced displacement of the coupling means during the inward movement of the locking means.

In the extremely rare case that the other end of the locking means is not situated opposite a catch recess of the coupling means, according to the invention, the locking means possesses a certain elasticity. This prevents wear and destruction of the components concerned.

In place of the aforesaid pin-like slide, it is also possible to use a slide which, in the region of the coupling means, surrounds this in the manner of a ring. This also enables a locking position of the locking means in which this is displaced towards the cam and extends, for example, in a groove on the outer peripheral surface of the cam. In contrast, in the case of the locking means with a pin-like configuration, the locking position is realized with the help of an elevation of the signal track on the outer peripheral surface of the cam.

Although the locking means of the invention are intended particularly for cooperating with coupling means configured as slides or pistons, the use of coupling means with other configurations is also conceivable. Possible alternatives are wedges, balls, snap projections and the like.

According to a further proposition of the invention, for uncoupling, the inner section is pivoted away from the outer section. However, the invention is equally applicable to configurations in which the two sections are axially displaceable relative to each other as described in the generic prior art document.

As a returning means for displacing the inner section from its pivoted position into its unpivoted position, the invention proposes a torsion spring. This can be configured at the same time as an axle for the mounting of the inner section in the recess of the outer section.

BRIEF DESCRIPTION OF THE DRAWINGS

The invention is described below with reference to the drawings in which.

DETAILED DESCRIPTION OF THE DRAWINGS

Figure 1:
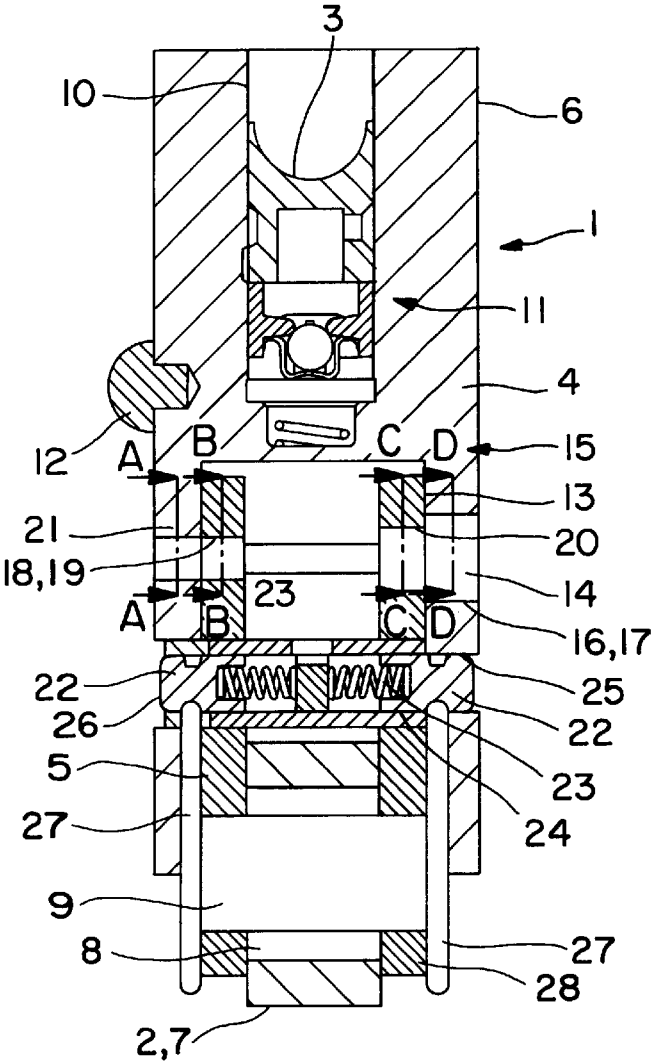
FIG. 1 is a longitudinal section through a cam follower according to the invention, with a view of the locking means which fix the coupling means in their coupling position.

FIG. 1 discloses a switchable cam follower 1 for a valve train of an internal combustion engine which can be actuated indirectly by tappet push rods. At one end, in the region of its contacting surface 2, the cam follower 1 can be loaded in lifting direction by a cam of a camshaft, not shown. In the region of a further end, the cam follower 1 acts through a support 3 on an end of a tappet push rod, also not shown. The tappet push rod, in its turn, loads at least one rocker arm.

The cam follower 1 comprises an outer and an inner section 4, 5. The outer section 4 is inserted with its outer peripheral 6 for longitudinal displacement in a reception of the internal combustion engine.

The contacting surface 2 for the cam is a component of the inner section 5 and configured in the present case as a roller 7. The roller 7 is mounted for rotation on a pin 9 by a rolling bearing 8, the pin 9 being fixed in the inner section 5. In the embodiment illustrated in the drawing, an end region of the inner section 5 having the contacting surface 2 projects out of an end of the cam follower 1.

In contrast, the support 3 for the end of the tappet push rod is received in a bore 10 which extends into the cam follower 1 from the other end thereof. The contact 3 forms a part of a hydraulic clearance compensation means 11 which does not need to be described more closely in the present context. Together with the support 3, the hydraulic clearance compensation means 11 forms a pressure piston.

A body 12 for preventing rotation of the cam follower 1 relative to its reception in the internal combustion engine is arranged on the outer peripheral surface 6 of the outer section 4. This body 12 can, for example, be a rolling element which projects radially outwards beyond the outer peripheral surface 6. However, it is also conceivable to arrange a radially inwards projecting body in the reception of the internal combustion engine to cooperate with a corresponding longitudinal groove on the outer peripheral surface 6. Alternatively, the outer peripheral surface 6 may comprise appropriate flattened regions which cooperate with opposing flat surfaces of the reception of the internal combustion engine.

To guarantee a disconnection of the gas exchange valve concerned from the cam, the inner section 5 is displaceable relative to the outer section 4 for the desired disconnection. In the prior art, this is achieved by the fact that one of the sections 5 or 4 is displaced axially relative to the other section 4 or 5. According to the present invention, however, the desired disconnected state is obtained by a pivoting of the inner section 5 relative to the outer section 4 by cam lift. For this purpose, the inner section 5 is inserted substantially into a recess 13 which extends in to the cam follower 1 from the end facing the cam.

The recess 13 is crossed by an axle 14 which extends diametrically through the cam follower 1. The outer regions of the axle 14 are mounted in the outer section 4. The end 15 of the inner section 5 remote from the contacting surface 2 is likewise arranged on the axle 14.

The axle 14 assumes, at the same time, the function of a torsion spring and comprises on one end, a first rotation preventing device 16 (see also FIG. 4) such as a polygon (in the present case, a square). This rotation preventing device 16 is rigidly arranged in a complementary reception 17 of the outer section 4. In a region at the axially largest distance from the first rotation preventing device 16, there is arranged in the inner section 5, a second rotation preventing device 18 such as a flattened region or a polygon (in the present case, a square). This second rotation preventing device 18 is likewise fixed in a complementary reception 19 of the inner section 5. Relative to further receptions 20, 21, the axle 14 is rotatable. The configuration provided by the invention enables an excellent twist of the axle 14.

Coupling means 22 in the form of slides are arranged axially below the axle 14 in the direction of the contacting surface 2 According to the embodiment of FIG. 1, two coupling means 22 situated opposite each other extend in the inner section 5. Each of these coupling means 22 can be loaded in radially outward direction by the force of a pressure-exerting means 23 such as a compression spring. FIG. 1 shows the coupled state of the sections 4, 5. Radially outwards opposite the coupling means 22 which are situated in receptions 24 of the inner section 5, receptions 25 are arranged in the outer section 4. These receptions 25 are configured at the same time to serve as displacement limiters for the coupling means 22 in outward direction.

For uncoupling the sections 4, 5, hydraulic medium can be routed to outer end faces 26 of the coupling means 22. The uncoupling of the sections 4, 5 is realized in the base circle phase of the loading cam. If the hydraulic medium pressure is sufficient for displacing the coupling means 22 radially inwards, these extend, at the latest by the end of the base circle phase, entirely in their receptions 24 in the inner section 5. In the cam rise phase, the cam, not shown, pivots the inner section 5 relative to the outer section 4. The axle 14 serves as the center of pivot, while the torsional spring force of the axle 14 holds the contacting surface 2 in constant contact with the cam. When the cam tip runs on, the inner section 5 is pivoted to a maximum relative to the outer section 4. The outer section 4 is not actuated axially in the opening direction of the gas exchange valve which thus remains closed. In the cam drop phase, the pivoted inner section 5 is returned entirely into its recess 13 in the outer section 4 by the torsional spring force of the axle 14 and by the force of gravity.

Figure 2:
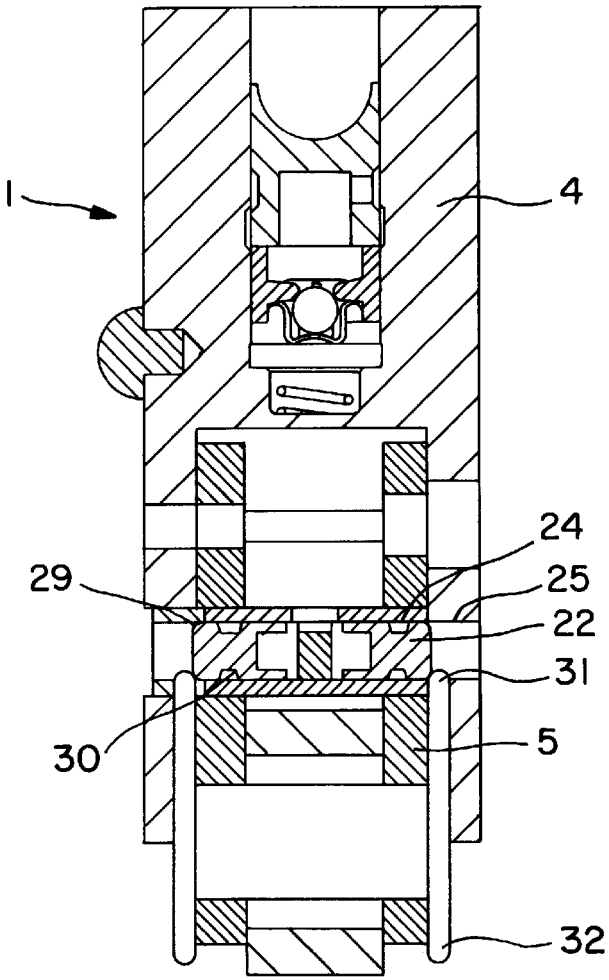
FIG. 2 is a view similar to that of FIG. 1 but showing the coupling means fixed in their uncoupling position within the inner section.

To limit the pivoting motion in return direction and to guarantee that the receptions 25, 24 for the coupling means 22 are aligned to each other in the base circle phase, the invention provides stop means 27. In the present embodiment, these stop means 27 are constituted by a radially inward projecting part of a bushing 28 which extends in the reception 25 of the outer section 4. For this, an outer peripheral surface 28 of the inner section 5 comprises a corresponding track having a stop surface (see also FIG. 2).

If after the return pivoting of the inner section 5 into its original position, which is reached in the base circle phase of the cam, the hydraulic medium pressure in front of the end faces 26 is reduced to a minimum, the means 23 re-displace the coupling means 22 partially into the receptions 25 in the outer section 4. Thus, when cam lift starts, the cam follower 1, together with the tappet push rod, follows this lift and the associated gas exchange valve opens.

To prevent a displacement of the coupling means 22 except during desired cam contact phases, (see introduction of the specification), locking means 27 provided by the invention are associated to the coupling means 22. These locking means 27 are configured as pin-like slides arranged diametrically opposite each other on the outer peripheral surface 28 of the inner section 5, a longitudinal guide for the locking means 27, not shown, being arranged on the outer peripheral surface 28 or in the recess (13). Each of the coupling means 22 illustrated in the drawings comprises two wedge-shaped catch recesses 29, 30 (see also FIG. 2). These catch recesses 29, 30 are spaced from each other at a distance corresponding to the dimension of a desired maximum displacement of the coupling means 22 from their coupled state into their uncoupled state. In the coupled state shown in FIG. 1, the locking means 27 engage by their ends 31 facing the coupling means 22 into the inner catch recesses 30. In this way, due to this positive engagement, the coupling means 22 can no longer be displaced.

What is not shown in the drawings is that the locking means 27 cooperate with their ends 32 situated opposite to their ends 31 with a signal track on the contacting cam. This signal track is configured so as to merge immediately before the beginning of the base circle into a groove. This enables the locking means 27 to release the coupling means 22 concerned. Just before the end of the base circle, the groove is raised or merges into an unrecessed portion of the outer peripheral surface of the cam. As a result, a forced displacement of the locking means 27 takes place in the direction of the coupling means 22 concerned. If the hydraulic medium pressure is sufficient for displacing the coupling means 22 from its coupling position into its uncoupling position, the locking means 27 engages by its end 31 into the catch recess 29. The coupling means 22 is now fixed. If the hydraulic medium pressure is insufficient, the coupling means 22 can be forced into its uncoupling position at the end of the base circle phase by the end 31 of the locking means 27 entering into the catch recess 29. It is obvious that the same applies to the return of the coupling means 22 into its coupling position.

For the most unfavorable case in which the end 31 of the locking means 27 comes to be situated on a region of the outer peripheral surface of the coupling means 22 between the catch recesses 29, 30, the locking means 27 of the invention possesses an adequate elasticity or yielding property to avoid a loading or a destruction of the components in this region.

Figure 3:
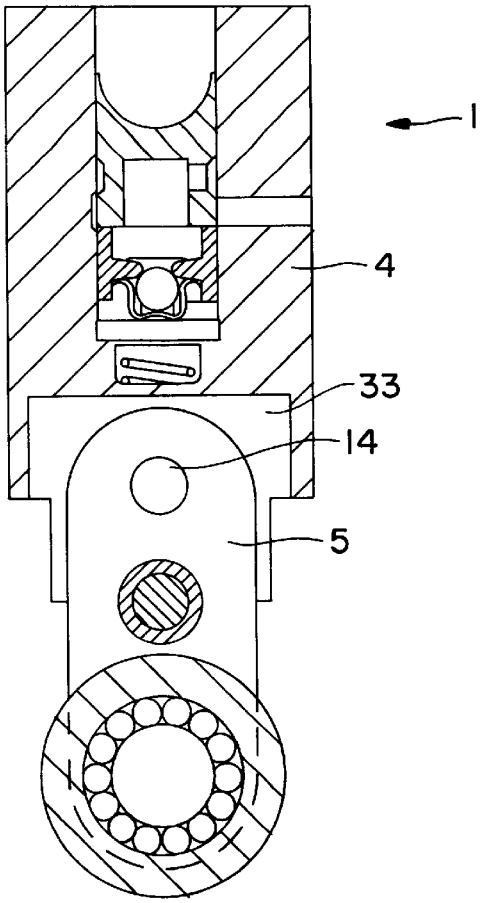
FIG. 3 is a sectional view turned through 90° relative to the preceding figures.
Figure 4B:
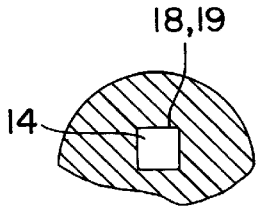
FIG. 4 shows sections A—A to D—D as identified in FIG. 1 through the cam follower in the region of its axle.
Figure 4A:
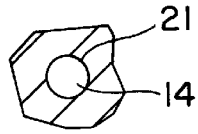
Figure 4C:
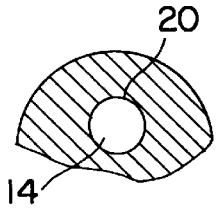
Figure 4D:
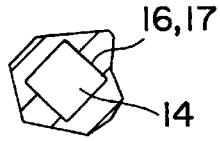

FIG. 3 shows the cam follower 1 of FIG. 1 in a sectional view turned through 90°. It can be seen that in the region of the inner section 5, the outer section 4 comprises a suitable recess 33 to guarantee an unobstructed pivoting of the inner section 5 relative to the outer section 4 during cam lift and for uncoupling. This recess 33 can be made, for example, by milling.

FIG. 4 shows the sectional views of the cam follower 1 identified in FIG. 1. The sections B—B and D—D illustrate the rotation preventing devices 18, 16 in the receptions 19, 17 of the inner section 5 and the outer section 4.

Figure 5:
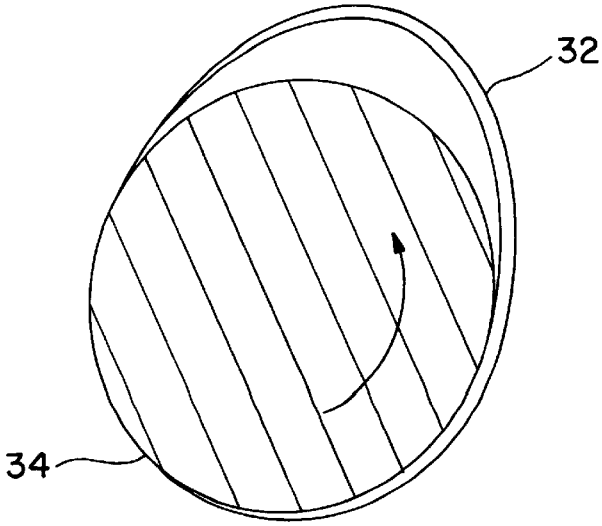
FIG. 5 shows the signal track for the locking means.

FIG. 5 is a cross-section through the locking means (27) wherein the signal track 32 is shown in the dark line. The surface of the cam forces the locking means (27) to block the coupling means (2) outside of a defined part of the base circle (34) phase of the cam. It is important that the coupling means (22) is fixed directly at the end of the base circle (34) and during a first portion of a valve lifting flank.

What is claimed is:

1. A switchable cam follower (1) for a valve train of an internal combustion engine, which valve train is actuated by tappet push rods, said cam follower having the following features:

the cam follower (1) is installed in driving relationship between a camshaft and an end of the tappet push rod, said cam follower (1) comprising an outer and an inner section (4,5) as well as coupling means (22), the outer section (4) is inserted with its outer peripheral surface (6) into a reception in an engine block of the internal combustion engine, the inner section (5) being mounted in a recess (13) of the outer section (4) while being movable relative to the outer section (4), one of said sections (4 or 5) has a support (3) for the end of the tappet push rod and the other of said sections (5 or 4) has an axially opposite contacting surface (2) for a cam of the camshaft, the recess (13) for the inner section (5) in the outer section (4) comprises an end (15) remote from the contacting surface (2), the inner section (5) is mounted in the recess (13) on an axle (14) which is guided in the outer section (4), and the inner section (5) is pivotable relative to the outer section (4) on the axle (14), said sections (4,5) can be coupled to each other by the coupling means (22) so that on coupling, a high lift of a valve train gas exchange valve which is loadable by the tappet push rod can be effected and, on uncoupling of the sections (4,5) by the coupling means (22), a low lift or a zero lift of the gas exchange valve is obtainable, characterized in that a locking means (27) is associated to the coupling means (22), and the locking means (2) is configured so as to permit a displacement of the coupling means (22) during a contact of a first portion of a base circle of the cam with the cam contacting surface and to block a displacement of the coupling means (22) during a contact of a last portion or an end of a base circle of the cam and during contact of an adjoining first portion of a valve lifting flank of the cam with the cam contacting surface.

2. A cam follower according to claim 1, characterized in that the coupling means (22) is made as a slide, a reception (24, 25) being arranged in each of the inner section (5) and the outer section (4), which receptions (24, 25) are aligned to each other for coupling of the sections (4,5), the receptions (24, 25) extend diametrically or secant-like through the cam follower (1), the coupling means (22) is arranged in one of the receptions (24 to 25) while being displaceable in at least one of its directions of displacement by a servo medium including a hydraulic medium and in the respective other direction of displacement by a mechanical means (23) including at least one compression spring, or likewise by a servo medium, the cam possesses a signal track for the locking means (27), the locking means (27) is made as a slide which, at one end (32), scans the signal tract while being associated at the other end (31) to the respective coupling means (22), the coupling means (22) comprises wedge-shaped catch recesses (29,30) which are spaced from each other at a distance corresponding to the dimension of a desired maximum displacement of the coupling means (22) from the coupled into the uncoupled state, and into which catch recesses (29,30) the other end (31) of the locking means (27) is forcibly displaceable by the signal track of the cam for blocking a displacement of the coupling means (22).

3. A cam follower according to claim 2, characterized in that the locking means (27) is guided on a longitudinal guide through or along one of the sections (4 or 5) and is made as a pin which engages into the catch recesses (29, 30) of the coupling means (22) on a side thereof opposite the cam.

4. A cam follower according to claim 2, characterized in that the outer section (4) possesses the support (3) for the end of the tappet push rod, and the inner section (5) comprises the contacting surface (2) for the cam, the inner section (5) is loaded against its direction of pivot by a spring means, and the outer section (4) can be guided secure against rotation in the reception in the engine block so that the receptions (24,25) for the coupling means (22) and the axle (14) extend parallel to the axis of the camshaft.

5. A cam follower according to claim 4, characterized in that the spring means for the inner section (5) is configured as a torsion spring which is constituted by the axle (14).

6. A cam follower according to claim 5, charactrized in that the axle (14) is fixed at one end by a first rotation preventin device (16) including a flattened region or a polygon in a complementary reception (17) of the outer section (4), while being fixed in the inner section (5) at an axially largest distance from the first rotation preventing device (16), by a section rotation preventing device (18) including a flattened region or a plygon in a complementary reception (19) of the inner section (5).

7. A cam follower according to claim 2 or 3, characterized in that the locking means (27) has an elastic configuration in the axial direction of the cam follower (1).

* * * * *